US007127206B2

(12) United States Patent
Morgenweck et al.

(10) Patent No.: US 7,127,206 B2
(45) Date of Patent: Oct. 24, 2006

(54) MICROWAVE ARRANGEMENT WITH RESONANCE STATE TUNING FOR AFFIXING TONER ONTO PRINTING MATERIAL

(75) Inventors: Frank-Michael Morgenweck, Molfsee (DE); Knut Behnke, Flintbek (DE); Hans-Otto Krause, Eckernförde (DE); Domingo Rohde, Kiel (DE); Lars Seimetz, Achterwehr (DE)

(73) Assignee: Eastman Kodak Company, Rochester, NY (US)

( * ) Notice: Subject to any disclaimer, the term of this patent is extended or adjusted under 35 U.S.C. 154(b) by 179 days.

(21) Appl. No.: 10/866,953

(22) Filed: Jun. 14, 2004

(65) Prior Publication Data

US 2005/0002703 A1 Jan. 6, 2005

(30) Foreign Application Priority Data

Jun. 16, 2003 (DE) ..... 103 26 964

(51) Int. Cl.
*G03G 15/20* (2006.01)
*H05B 1/00* (2006.01)

(52) U.S. Cl. ..... 399/336; 219/216; 219/696; 399/122

(58) Field of Classification Search ..... 399/107, 399/122, 320, 335, 336, 337; 219/216, 678, 219/690, 694, 696
See application file for complete search history.

(56) References Cited

U.S. PATENT DOCUMENTS

| | | | | |
|---|---|---|---|---|
| 4,482,239 | A * | 11/1984 | Hosono et al. | 399/336 |
| 5,410,283 | A * | 4/1995 | Gooray et al. | 333/159 |
| 6,020,579 | A * | 2/2000 | Lewis et al. | 219/696 |
| 6,614,010 | B1 * | 9/2003 | Fagrell et al. | 219/690 |
| 6,630,653 | B1 * | 10/2003 | Gerdes et al. | 219/695 |

FOREIGN PATENT DOCUMENTS

DE 102 10 936 C1 10/2003

* cited by examiner

*Primary Examiner*—Hoan Tran
(74) *Attorney, Agent, or Firm*—Lawrence P. Kessler

(57) ABSTRACT

A microwave arrangement for affixing the toner onto a printing material by heating, wherein a resonator chamber for feeding printing material therethrough includes at least one element, which extends into the resonator chamber and is used for tuning the resonance state in the resonator chamber. The element includes at least a first portion of a material with properties that essentially do not absorb the microwave radiation and a second portion of a material with mechanically stable properties and a slightly higher absorption of the microwave radiation than the first portion.

18 Claims, 2 Drawing Sheets

MICROWAVE ARRANGEMENT WITH RESONANCE STATE TUNING FOR AFFIXING TONER ONTO PRINTING MATERIAL

FIELD OF THE INVENTION

The invention relates to a microwave arrangement for affixing toner onto a printing material including an element with a material having a portion that does not absorb microwaves, and a portion, which does absorb microwaves.

BACKGROUND OF THE INVENTION

In printing presses, a toner material is applied to a printing material during various printing processes. The toner material or toner is affixed securely onto printing material or interlaced therewith. After the printing process, the toner should be fused securely to the printing material without smears. For this purpose, frequent use is made of fuser rolls that apply heat and pressure to both sides of the tonered printing material and melt and fuse the toner, which has been applied in various ways, to the printing material. This has disadvantages, for example, the wear and tear of the fuser rolls and the risk of damaging the printing material.

One solution to overcome these problems includes using contact-free fusing arrangements that do not touch the printing material during the fusion or affixing of the toner to the printing material. In the prior art, it has been recommended, among other things, that the fusion be accomplished by microwave radiation as the printing material travels through a microwave resonator. When this recommended solution is implemented, however, problems occur if different printing materials are used, wherein the printing material is not uniformly and properly heated. A terminating sliding valve or a short-circuit valve on a microwave arrangement, which is used to adjust the resonance state or the resonance condition, requires good contact in order to avoid electrical flashovers and is unsuitable for the high number of adjustment operations for different printing materials.

SUMMARY OF THE INVENTION

The purpose of the invention is therefore to ensure the quick and uncomplicated fusion of toner onto a printing material. An additional objective of the invention is to adjust the fusion of toner onto different types of printing material in an appropriate manner.

According to this invention, a microwave arrangement is provided for affixing the toner onto a printing material by heating. The microwave arrangement includes a resonator chamber with at least one opening for feeding through the printing material. At least one element extends into the resonator chamber and is used for tuning the resonance state in the resonator chamber. The element includes at least a first portion of a material having properties that essentially do not absorb the microwave radiation and a second portion of a material having mechanically stable properties and a slightly higher absorption of the microwave radiation than the first portion.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
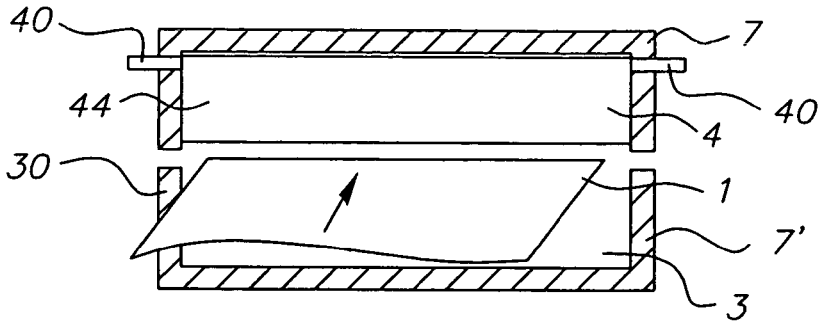
FIG. 1, which shows a schematic section of a resonator chamber with a specially formed element.

FIG. 1 shows a schematic perspective view of a resonator chamber 3 of an embodiment of the invention, using the example of a TE 101 Resonator, which is included in a microwave arrangement. In the resonator chamber 3, there is a stationary microwave. The resonator chamber 3 has two parts, a first part 7 and a second part 7', which are arranged opposite each other, wherein the interiors of the first part 7 and the second part 7' together form the chamber of the resonator chamber 3. A slit is provided between parts 7 and 7' through which a printing material 1 is transported through the resonator chamber 3. The element 4 is essentially located in the resonator chamber 3, and the axis 40 of the element 4 extends through a wall 30 of the first part 7 from the outside into the resonator chamber 3. The presence of the element 4 in the resonator chamber 3 changes the resonance state or resonance condition in the resonator chamber 3.

As shown in FIGS. 3–6, the element 4 has at least a first portion 41 of a material with properties that essentially do not absorb the microwave radiation and a second portion 42 of a material with mechanically stable properties. The position of the element 4 influences the resonance condition in the resonator chamber 3 and tunes the resonance condition, at any given time, to the printing material 1 located in the resonator chamber 3. In this way, the paper or printing material temperature that changes for different paper and printing material weights is taken into account during fusion of the toner. If the resonance state or the resonance condition in the microwave arrangement is fulfilled, then the microwave radiation of the microwave arrangement is launched into the printing material and heats it.

The adjustment of the resonance condition to different paper and printing material weights by a rotation of the element 4 enables a maximum launching, under the prevailing boundary conditions, of the available microwave power.

Since different amounts of energy are required to heat the same type of printing materials 1 with different base weights to a certain temperature, the microwave power must also be adjusted accordingly. Reference tables are listed that clearly and precisely assign a certain base weight of a printing material 1 to a certain position of the element 4, with such a degree of accuracy that the printing material 1 and the element 4 jointly yield an optimal resonance condition in the resonator chamber 3 for the frequency supplied by the microwave source. As a rule, the base weight of the printing material 1 is known in the control unit of the printing press, particularly in digital printing presses in which different printing materials 1 having different masses are printed in quick succession. The element 4 is preferably moved by an appropriate control, dependent upon the data output of the reference table.

For certain embodiments of the element 4, stepper motors can be used beneficially to move the element 4. Another specified possibility for moving the element 4 is an electrically-driven control magnet that is coupled with the element 4 and that therefore moves the element 4. By moving the element 4, the resonance condition in the resonator chamber 3 is constantly tuned in a way that results in the energy-efficient heating of the printing material 1 and the toner lying on it, so that the toner is fused to the printing material 1. In this example, the element 4 is depicted as a variant that can be rotated around its own axis 40. In this case, the element 4 includes an axis 40 with at least one wing 44, wherein the axis 40 of the element 4 extends through its walls 30 on opposite sides of the resonator chamber 3. During a rotation of the axis 40, the wing 44 of the element 4 moves through the resonator chamber 3. The axis 40 runs as far as possible toward the upper boundaries of the resonator chamber 3. In FIG. 1, an embodiment of the element 4 is depicted in its first position.

Figure 2A:
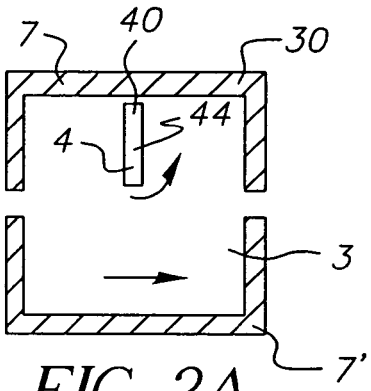
FIG. 2A, which shows a schematic side section of a resonator chamber with an embodiment of the element in a first position according to FIG. 1.
Figure 2B:
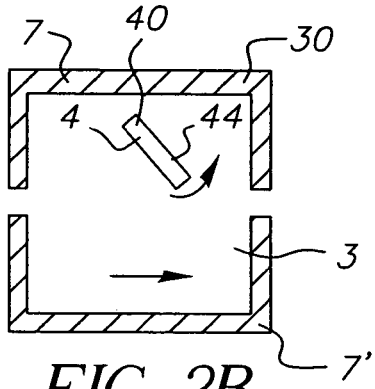
FIG. 2B, which shows a schematic side section of the resonator chamber with an embodiment of the element in a second position according to FIG. 2A.
Figure 2C:
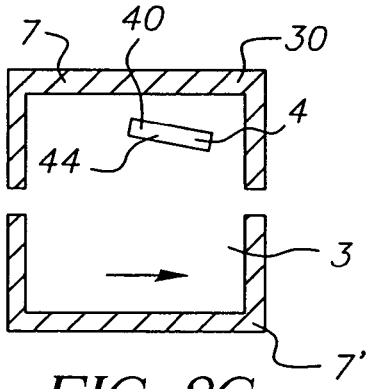
FIG. 2C, which shows a schematic side section of the resonator chamber with an embodiment of the element in a third position according to FIG. 2A.

FIG. 2A shows a schematic side section of the resonator chamber 3 with the two parts 7 and 7', with an embodiment of the element 4 in a first position according to FIG. 1, wherein the wing 44 of the element 4 is arranged somewhat vertical in a downward direction. In this example, the first position of the element 4 is adjusted for heating a certain printing material 1 (e.g. with a base weight of 60 g/m$^2$). If, after fusing the printing material 1 with a base weight of 60 g/m$^2$, the printing press is operated with another printing material 1, such as a printing material 1 with a base weight of 180 g/m$^2$, then sufficient heating will not be achieved with the position of the element 4 according to FIGS. 1 and 2A. When another printing material 1 with a base weight of 180 g/m$^2$ is fed into the microwave arrangement in the printing press, a stepper motor causes a rotation of the axis 40 of the element 4 into a second position according to FIG. 2B, as depicted by the arrow. During rotation of the axis 40 of the element 4, the wing 44 that is connected as a single piece to the axis 40 is rotated. In the second position of the element 4, the printing material 1 with a base weight of 180 g/m$^2$ is appropriately heated in order to fuse the toner. If toner is fused onto a printing material 1 with another base weight, for example 300 g/m$^2$, then the axis 40 is further rotated, and the wing 44 assumes, for example, a position according to FIG. 2C, in which the wing 44 is located somewhat horizontally in the first part 7 of the resonator chamber 3.

Figure 3:
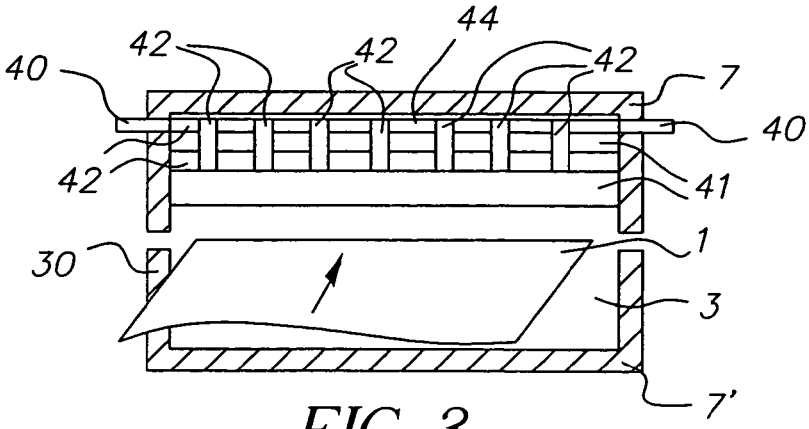
FIG. 3, which shows a schematic section of the resonator chamber with an embodiment of the invention, wherein the element includes a cross-barred second portion of the material with mechanically stable properties.

FIG. 3 shows a schematic view similar to FIG. 1 in which the element 4 includes at least a first portion 41 of a material with properties that essentially do not absorb the microwave radiation and a second portion 42 of a material with mechanically stable properties. The material of the second portion 42 has a somewhat higher absorption of the microwave radiation in the resonator chamber 3. Other portions of the material can be embodied. The first portion 41 contains, for example, polytetraflouroethylene, and hereby includes essential parts of the wing 44. The second portion 42 contains, for example, quartz glass, steatite, polyether sulfone, poly-P-obenoxate, polyether imide, polysufone, nylatron, novatron, polyphenylene sulfide, ketron, metal, or combinations thereof and includes parts of the wing 44 and the axis 40. The second portion 42 can also be formed of composite materials, such as polytetraflouroethylene with Kevlar or polytetraflouroethylene with glass fibers.

The axis 40 is the most mechanically stressed part of the element 4. The second portion 42 has mechanically stable properties and serves to stabilize the element 4, which includes the first portion 41 from a less mechanically stable material. The first portion 41 leads to very low energy loss in the resonator chamber 3 but when considered, for example, over longer periods of operation, its material has the disadvantage of developing undesirable deformations and exhibiting a high degree of abrasion. The second portion 42, on the other hand, has a higher energy loss than the first portion 41 but, due to the mechanical stability of its material, has hardly any deformations or abrasion.

In the resonator chamber 3, a stationary microwave is formed wherein, in areas in the element 4 with high electrical field strength, the first portion 41 is embodied and, in areas in the element 4 with lower electrical field strength, the second portion 42 is embodied. Furthermore, due to its higher absorption of microwave radiation, the entire axis 40 can be located in an area with low electrical field strength, so that little heating of the axis 40 occurs or the heat is dissipated via the surface. The utilized material of the second portion 42 is selected depending upon the position of the axis 40. In this way, energy losses that occur due to the second portion 42 remain low. The desired stabilizing properties are nevertheless essentially achieved by the second portion 42.

Another possibility for attaching a stabilizing second portion 42 to the element 4 is forming the element 4 with a first portion 41 and coating the lateral surfaces of the wing 44 of the element 4 with the second portion 42. In this way, a kind of sandwich structure is formed, wherein the second portion 42 surrounds the first portion 41. In the example presented in FIG. 3, the second portion 42, which is made from a mechanically stable material, forms a cross-barred structure in the upper part of the wing 44; and the areas with the second portion 42 run longitudinally and vertically to this along the wing 44 of the element 4 in stripes that are arranged parallel to one another. Areas of the first portion 41 alternate longitudinally and crosswise with areas of the second portion 42. This cross-barred structure with the second portion 42 is formed only in the upper part of the wing 44 of the element 4 because it is there that areas with lower electrical field strength prevail in the resonator chamber 3. The second portion 42, which absorbs more of the microwave radiation, is heated only slightly in these areas. In the areas with higher electrical field strength in the lower part of the wing 44, only the first portion 41 is formed, which absorbs less of the microwave radiation.

Figure 4:
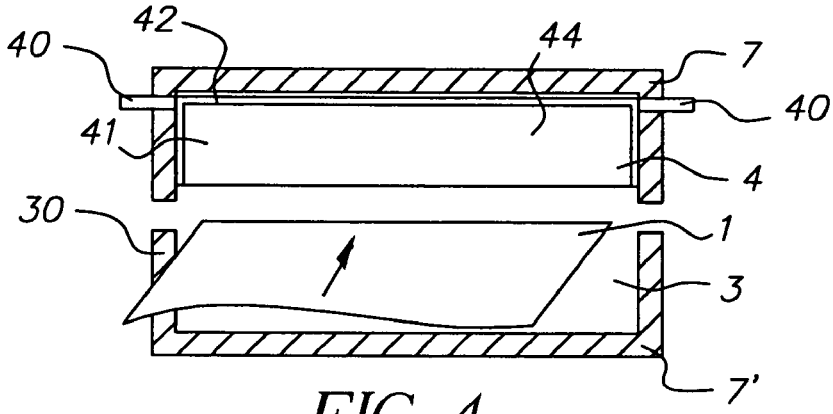
FIG. 4, which shows a schematic section of the resonator chamber with an embodiment of the invention, wherein the element with the second portion of the material has mechanically stable properties and includes lateral surfaces of the element.

FIG. 4 shows a schematic section of the resonator chamber 3 with an embodiment of the invention similar to FIG. 3, wherein the element 4 having material that has mechanically stable properties (i.e. with the second portion 42), contains the top side and lateral surfaces of the wing 44 but not, however, the underside of the wing 44 in which a high electrical field strength is formed. On the top side and the lateral surfaces of the wing 44, in the second portion 42, areas of the microwave field with smaller electrical field strengths are shown. The second portion 42 thus has a very narrow shape, particularly with respect to the lateral surfaces of the wing 44, since the microwave field from the side of the resonator chamber 3 forms a strong gradient. In the center of the wing 44, the element 4 is formed with a first portion 41 of a material having properties that essentially do not absorb the microwave radiation, while the lateral surfaces, with the exception of the underside of the element 4, contain a second portion 42 of a material with mechanically stable properties.

Figure 5:
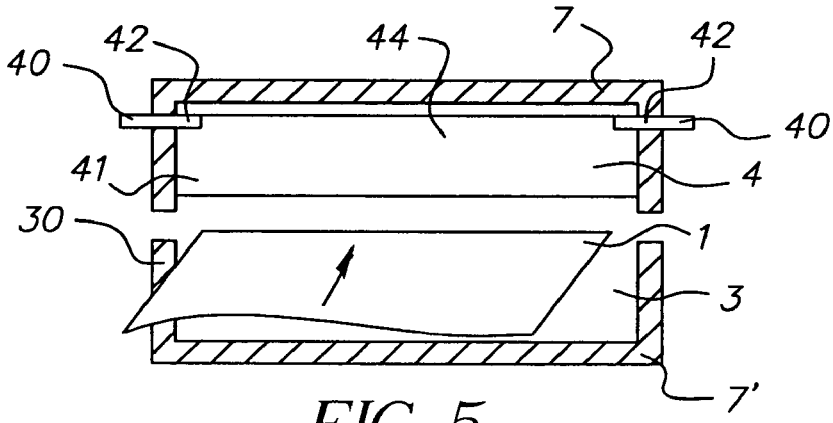
FIG. 5, which shows a schematic section of the resonator chamber with an embodiment of the invention, wherein the element with the second portion of the material has mechanically stable properties and includes parts of the axis penetrating the wall of the resonator chamber.

FIG. 5 shows a schematic section of the resonator chamber 3 with an embodiment of the invention. The element 4 with the second portion 42 that has material with mechanically stable properties hereby contains the parts of the axis 40 when the element 4 reaches through the wall 30 of the first part 7 of the resonator chamber 3. The second portion 42 is formed from two pins, each of which clamps onto one side of the first part 7 of the resonator chamber 3 and is connected as a single piece to the axis 40 of the element 4. The remaining parts of the element 4, the wing 44, and the portion of the axis 40 in the interior of the resonator chamber 3 that is separated from the wall 30, are formed from the first portion 41.

Figure 6:
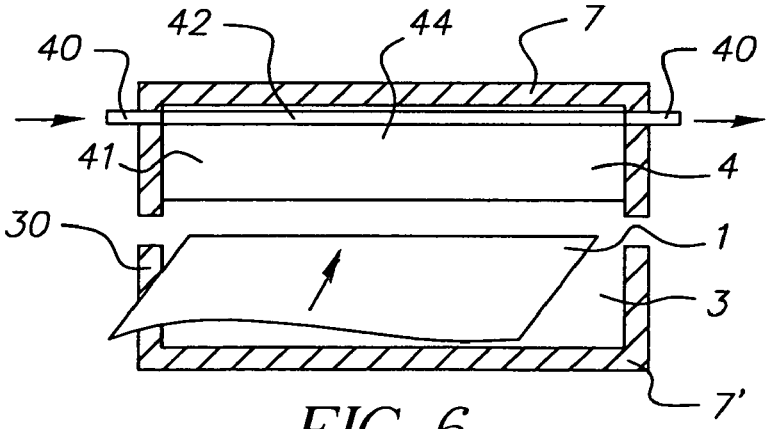
FIG. 6, which shows a schematic section of the resonator chamber, with a special embodiment of the invention, wherein a cooling agent flows through the axis of the element.

FIG. 6 shows an alternative embodiment of the invention with a schematic section. The element 4 is formed by an axis 40 and a wing 44 that is connected to it as a single piece. The axis 40 hereby contains the mechanically stable second portion 42. A special feature of this construction is the hollow design of the axis 40 of the element 4. A cooling agent is fed to the axis 40 as depicted by the arrow in FIG. 6. The cooling agent is, for example, air or another suitable agent. The cooling agent exits the axis 40 on the opposite side of the resonator chamber 3 through the wall 30 of the resonator chamber 3, as the arrow indicates. The cooling of the axis 40 from the second portion 42 means that, in the presence of the high temperatures occurring in the resonator chamber 3, the material is subjected to less stress. In particular, deformations of the element 4 are considerably reduced when viewed over longer periods of time. This takes into account the requirement that only slight deformations of the element 4 will be tolerated, otherwise the element 4 in the resonator chamber 3 could, for example, jam.

Another possibility is that of structuring the top surface or parts of the top surface of the wing 44 and having a cooling agent, e.g., air, flow around it. The larger surface area created by this structuring, as compared to a flat surface, achieves an additional cooling effect.

In another embodiment, the second portion 42 is metal, wherein the metal has the special property of substantially reflecting the microwave radiation and, for this reason, being applicable only in exceptional cases.

The invention has been described in detail with particular reference to certain preferred embodiments thereof, but it will be understood that variations and modifications can be effected within the spirit and scope of the invention.

What is claimed is:

1. Microwave arrangement for affixing toner onto printing material (1) by heating, wherein a resonator chamber (3), for feeding printing material (1) therethrough, comprising at least one element (4) extending into the resonator chamber (3), used for tuning the resonance state in the resonator chamber (3), said at least one element (4) including at least a first portion (41) of a material with properties that essentially do not absorb the microwave radiation and a second portion (42) of a material with mechanically stable properties and a slightly higher absorption of the microwave radiation than the first portion (41).

2. Microwave arrangement according to claim 1, wherein said first portion (41) projects into areas of the resonator chamber (3) in which a high electrical field strength prevails, and said second portion (42) projects into areas of the resonator chamber (3) in which a low electrical field strength prevails.

3. Microwave arrangement according to claim 2, wherein said mechanically stable second portion (42) includes a material that absorbs only slight amounts of the microwave radiation.

4. Microwave arrangement according to claim 3, wherein said mechanically stable second portion (42) includes an axis (40) of the element (4).

5. Microwave arrangement according to claim 3, wherein said mechanically stable second portion (42) includes the sections of the element (4) that are located at the walls (30) of the resonator chamber (3).

6. Microwave arrangement according to claim 3, wherein said mechanically stable second portion (42) is a coating on the first portion (41).

7. Microwave arrangement according to claim 3, wherein said mechanically stable second portion (42) has a cross-barred structure in the first portion (41) of the element (4).

8. Microwave arrangement according to claim 3, wherein said mechanically stable second portion (42) includes quartz glass.

9. Microwave arrangement according to claim 3, wherein said mechanically stable second portion (42) includes steatite.

10. Microwave arrangement according to claim 3, wherein said mechanically stable second portion (42) includes polyether sulfone.

11. Microwave arrangement according to claim 3, wherein said mechanically stable second portion (42) includes poly-P-obenoxate.

12. Microwave arrangement according to claim 3, wherein said mechanically stable second portion (42) includes polyetherimide.

13. Microwave arrangement according to claim 3, wherein said mechanically stable second portion (42) includes polysufone.

14. Microwave arrangement according to claim 3, wherein said mechanically stable second portion (42) includes nylatron.

15. Microwave arrangement according to claim 3, wherein said mechanically stable second portion (42) includes novatron.

16. Microwave arrangement according to claim 3, wherein said mechanically stable second portion (42) includes polyphenylene sulfide.

17. Microwave arrangement according to claim 3, wherein said mechanically stable second portion (42) includes ketron.

18. Microwave arrangement according to claim 2, wherein said first portion (41) of a material that includes polytetraflouroethylene properties that essentially do not absorb the microwave radiation.

* * * * *